US008758863B2

(12) United States Patent
Malshe et al.

(10) Patent No.: US 8,758,863 B2
(45) Date of Patent: Jun. 24, 2014

(54) METHODS AND APPARATUS FOR MAKING COATINGS USING ELECTROSTATIC SPRAY

(75) Inventors: Ajay P. Malshe, Springdale, AR (US); Wenping Jiang, Fayetteville, AR (US); Justin B. Lowrey, Fayetteville, AR (US)

(73) Assignees: The Board of Trustees of the University of Arkansas, Little Rock, AR (US); NanoMech, Inc., Fayetteville, AR (US)

( * ) Notice: Subject to any disclaimer, the term of this patent is extended or adjusted under 35 U.S.C. 154(b) by 659 days.

(21) Appl. No.: 12/446,031

(22) PCT Filed: Oct. 18, 2007

(86) PCT No.: PCT/US2007/022220

§ 371 (c)(1),
(2), (4) Date: Oct. 26, 2010

(87) PCT Pub. No.: WO2008/051433

PCT Pub. Date: May 2, 2008

(65) Prior Publication Data

US 2011/0033631 A1 Feb. 10, 2011

Related U.S. Application Data

(60) Provisional application No. 60/852,931, filed on Oct. 19, 2006.

(51) Int. Cl.
*B05D 1/06* (2006.01)
*B05D 3/02* (2006.01)

(52) U.S. Cl.
USPC ..... 427/475; 427/485; 427/486; 239/704

(58) Field of Classification Search
USPC ..... 427/475, 485, 486
See application file for complete search history.

(56) References Cited

U.S. PATENT DOCUMENTS

| | | | | | |
|---|---|---|---|---|---|
| 3,985,297 | A | * | 10/1976 | Itoh | 239/698 |
| 4,031,278 | A | | 6/1977 | Patel | |
| 4,105,571 | A | | 8/1978 | Shaub et al. | |
| 4,168,241 | A | | 9/1979 | Kozima et al. | |
| 4,334,928 | A | | 6/1982 | Hara et al. | |
| 4,715,972 | A | | 12/1987 | Pacholke | |
| 4,745,010 | A | | 5/1988 | Sarin et al. | |
| 4,842,893 | A | | 6/1989 | Yializis et al. | |
| 4,877,677 | A | | 10/1989 | Hirochi et al. | |
| 4,933,105 | A | * | 6/1990 | Fong | 424/462 |
| 5,102,592 | A | | 4/1992 | McCauley et al. | |

(Continued)

FOREIGN PATENT DOCUMENTS

| | | |
|---|---|---|
| JP | 2004113931 | 4/2004 |
| JP | 2004160388 | 6/2004 |
| JP | 2005342657 | 12/2005 |

*Primary Examiner* — Frederick Parker
(74) *Attorney, Agent, or Firm* — J. Charles Dougherty

(57) ABSTRACT

Methods for creating coatings composed of a single material or a composite of multiple materials, beginning with ESC to deposit the base layer and then using other methods for the binding step beyond CVI. Also, for certain materials and applications, some pre-processing or pre-treatment of the coating materials is necessary prior to deposition in order to achieve a satisfactory coating. This application discloses methods for pre-deposition treatment of materials prior to ESC deposition. It also discloses methods for post-processing that provide additional functionality or performance characteristics of the coating. Finally, this application discloses certain apparatus and equipment for accomplishing the methods described herein.

27 Claims, 9 Drawing Sheets

(56) References Cited

U.S. PATENT DOCUMENTS 5,129,918 A 7/1992 Chattopadhay
5,273,790 A 12/1993 Herb et al.
5,286,565 A 2/1994 Holzl et al.
5,328,875 A 7/1994 Ueda et al.
5,330,854 A 7/1994 Singh et al.
5,363,821 A 11/1994 Rao et al.
5,389,118 A 2/1995 Hinterman et al.
5,391,422 A 2/1995 Omori et al.
5,407,464 A 4/1995 Kaliski
5,441,762 A 8/1995 Gray et al.
5,451,260 A 9/1995 Versteeg et al.
5,466,642 A 11/1995 Tajima et al.
5,500,331 A 3/1996 Czekai et al.
5,503,913 A 4/1996 Konig et al.
5,534,808 A 7/1996 Takaki et al.
5,614,140 A 3/1997 Pinneo
5,654,042 A * 8/1997 Watanabe et al. ..... 427/459
5,677,060 A 10/1997 Terentieva et al.
5,679,399 A 10/1997 Shlenker et al.
5,704,556 A 1/1998 McLaughlin
5,711,489 A * 1/1998 Yanagida et al. ..... 239/697
5,733,609 A 3/1998 Wang
5,766,783 A 6/1998 Utsumi et al.
5,800,866 A 9/1998 Myers et al.
5,830,813 A 11/1998 Yao et al.
5,834,689 A 11/1998 Cook
5,882,777 A 3/1999 Kukino et al.
5,889,219 A 3/1999 Moriguchi et al.
5,897,751 A 4/1999 Makowiccki et al.
5,902,671 A 5/1999 Kutscher
5,928,771 A 7/1999 DeWald, Jr. et al.
5,945,166 A 8/1999 Singh et al.
5,985,356 A 11/1999 Schultz et al.
6,004,617 A 12/1999 Schultz et al.
6,053,420 A * 4/2000 Ahlbert et al. ..... 239/3
6,196,910 B1 3/2001 Johnson et al.
6,217,843 B1 4/2001 Homyonfer et al.
6,240,873 B1 6/2001 Bertellotti et al.
6,258,139 B1 7/2001 Jensen
6,258,237 B1 7/2001 Gal-Or et al.
6,276,618 B1 * 8/2001 Yanagida et al. ..... 239/693
6,346,290 B1 2/2002 Schultz et al.
6,368,665 B1 4/2002 Hunt et al.
6,372,012 B1 4/2002 Majagi et al.
6,406,738 B1 * 6/2002 Hogan et al. ..... 427/2.14
6,410,086 B1 6/2002 Brandon et al.
6,484,826 B1 11/2002 Anderson et al.
6,540,800 B2 4/2003 Sherman et al.
6,544,599 B1 4/2003 Brown et al.
6,607,782 B1 8/2003 Malshe et al.
6,756,119 B1 6/2004 Clough
6,852,948 B1 2/2005 Harrison
6,861,088 B2 3/2005 Weber et al.
6,864,201 B2 3/2005 Schultz et al.
6,874,712 B2 * 4/2005 Milojevic et al. ..... 239/690
6,933,049 B2 8/2005 Wan et al.
6,933,263 B2 8/2005 Manka et al.
6,962,895 B2 11/2005 Scharf et al.
7,018,606 B2 3/2006 Tenne et al.
7,018,958 B2 3/2006 Arrowsmith et al.
7,022,653 B2 4/2006 Hartley et al.
7,034,091 B2 4/2006 Schultz et al.
7,052,532 B1 5/2006 Liu et al.
7,060,319 B2 6/2006 Fredrickson
7,247,346 B1 7/2007 Sager et al.
7,250,195 B1 7/2007 Storey et al.
7,442,665 B2 10/2008 Schultz et al.
2002/0176989 A1 11/2002 Knudsen et al.
2003/0003237 A1 1/2003 Seabaugh et al.
2003/0025014 A1 2/2003 Sun et al.
2003/0162179 A1 8/2003 Potyrailo et al.
2003/0219544 A1 11/2003 Smith et al.
2004/0018238 A1 1/2004 Shukla
2004/0038808 A1 2/2004 Hampden-Smith et al.
2004/0228963 A1 11/2004 Bergh et al.
2005/0064088 A1 3/2005 Fredrickson
2005/0079200 A1 4/2005 Rathenow et al.
2005/0123759 A1 6/2005 Weinberg et al.
2005/0233062 A1 10/2005 Hossainy et al.
2005/0244644 A1 11/2005 Hampden-Smith et al.
2005/0266170 A1 * 12/2005 Nesbitt ..... 427/475
2006/0120947 A1 6/2006 Tenne et al.
2006/0177573 A1 8/2006 Pui et al.
2006/0193890 A1 8/2006 Owens et al.
2006/0198940 A1 9/2006 McMorrow
2006/0198941 A1 9/2006 Behan et al.
2006/0198942 A1 9/2006 O'Connor et al.
2006/0199013 A1 9/2006 Malshe et al.
2006/0219294 A1 10/2006 Yabuuchi et al.
2006/0275542 A1 12/2006 Mehta et al.
2007/0003749 A1 1/2007 Asgari
2007/0004884 A1 1/2007 Bildstein
2007/0065668 A1 3/2007 Idei
2007/0154634 A1 7/2007 Renn
2007/0224239 A1 9/2007 Behan et al.
2008/0029625 A1 2/2008 Talton
2008/0050450 A1 2/2008 Arnold et al.
2008/0066375 A1 3/2008 Roos et al.
2008/0166493 A1 7/2008 Xiao et al.
2008/0280141 A1 11/2008 Dobbs et al.
2008/0305259 A1 12/2008 Saijo
2008/0311306 A1 12/2008 Xiao et al.
2008/0312111 A1 12/2008 Malshe et al.

* cited by examiner

METHODS AND APPARATUS FOR MAKING COATINGS USING ELECTROSTATIC SPRAY

This application is the National Stage of International Application No.

PCT/US2007/022220, filed 18 Oct. 2007, which claims the benefit of U.S. Provisional Application No. 60/852,931, entitled "Methods and Apparatus for Making Coatings Using Electrostatic Spray," and filed on Oct. 19, 2006, both of which are incorporated herein by reference.

BACKGROUND OF THE INVENTION

The present invention relates to methods and apparatus for making coatings and articles from various material compositions involving use of electrostatic spray as the core method of coating deposition. These coatings may be used for a variety of applications, including as examples: abrasion-resistant coatings for cutting tools and wear parts, solid lubricant coatings for tools and wear parts, bio-friendly or biocidal coatings for biomedical implants, and thin film coatings for microelectronics, among others. Using the processes and equipment designs described in the detailed description section hereof, coatings may be applied to many different substrate materials and parts having simple or complex 3-dimensional geometries.

U.S. Pat. No. 6,607,782 issued Aug. 19, 2003 to Ajay P. Malshe, et al., disclosed a method that uses electrostatic spray coating (ESC) to deposit a base layer or preform on a substrate, followed by chemical vapor infiltration (CVI) to introduce a binder phase that creates a composite coating with good adherence of the binder to the initial phase particles and adherence of the composite coating to the substrate.

SUMMARY OF THE INVENTION

The present invention comprises additional methods for creating coatings composed of a single material or a composite of multiple materials, beginning with ESC to deposit the base layer and then using other methods for the binding step beyond CVI. ESC followed by CVI has been used successfully for creating composite coatings comprised of cubic boron nitride (cBN) and titanium nitride (TiN), on carbide substrates. However, because CVI exposes the substrate to high temperatures it is not suitable for certain materials that may be damaged or their properties degraded by the high temperature. Also, CVI as a binding step is not practical for applications involving very large surface areas due to the limited size of CVI reactors. Due to these and other limitations, we have devised additional means of applying a second phase to initial green coatings deposited using ESC. The new two-step coatings processes that result are disclosed in this application.

Also, for certain materials and applications, some pre-processing or pre-treatment of the coating materials is necessary prior to deposition in order to achieve a satisfactory coating. The invention in various embodiments comprises methods for pre-deposition treatment of materials prior to ESC deposition. It also comprises in various embodiments methods for post-processing that provide additional functionality or performance characteristics of the coating.

Finally, the invention in various embodiments comprises certain apparatus and equipment for accomplishing the methods described herein.

DETAILED DESCRIPTION OF THE PREFERRED EMBODIMENTS

Disclosed herein are methods and apparatus for producing a coating on a substrate, beginning with electrostatic spray to deposit a base- or green-coating layer.

Two-Step Coating Processes—Overview

Figure 1:
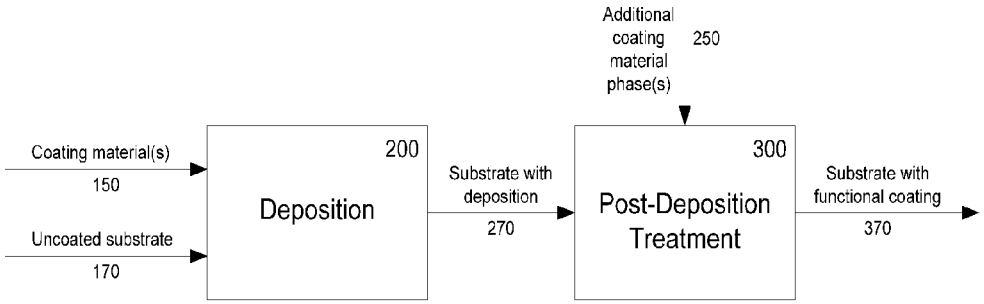
FIG. 1 illustrates the two-step coating process, including an initial deposition of a base or green coating layer, followed by a post-deposition treatment step.

FIG. 1 illustrates a two-step process for producing a coating on a substrate.

The substrate 170 is placed in a deposition system 200. One or more coating materials 150 are introduced into the deposition system 200. These coating materials may be in dry powder or liquid suspension form, and may contain nano- or micro-sized particles or a combination of the two. Multiple materials may be combined together or introduced separately into the deposition system 200. A variety of materials can be used, including nitrides, carbides, carbonitrides, borides, oxides, sulphides and silicides.

The deposition system 200 may use any of several methods to produce an initial coating or base layer on the substrate. One such deposition method is electrostatic spray coating (ESC), as described in U.S. Pat. No. 6,544,599 issued Apr. 8, 2003 to William D. Brown, et al., and U.S. Pat. No. 6,607,782 issued Aug. 19, 2003 to Ajay P. Malshe, et al. ESC deposition may be done as dry powder spray, or as liquid spray using a dispersion of the coating material in a suitable carrier liquid.

After the initial deposition step, dry solid particles of the coating material(s) are in contact with the substrate. The substrate with deposition 270 is the output of the deposition step 200 as illustrated in FIG. 1.

The substrate 270 with deposition of a base layer then undergoes a post-deposition treatment step 300. Post-deposition treatment is used to bind the deposited dry particles to one another and to the substrate. Suitable treatment methods include:

Chemical vapor infiltration (CVI), which is similar to chemical vapor deposition (CVD) but using a slower reaction rate such that the binder infiltrates the porous dry powder deposition, coming into contact with both the substrate and the dry particles; and Sintering, using any of several alternative sintering methods, singly or in combination, including:
- Microwave sintering
- Laser sintering
- Infrared sintering Each of these methods applies one or more short bursts of high energy (microwave, laser, infrared, or high temperature and high pressure) to sinter the particles of the initial coating deposition, binding them to each other and to the substrate.

Another binding method is use of high temperature—high pressure (HT-HP), a process that is currently used for a variety of purposes including fabrication of polycrystalline cubic boron nitride (PCBN) solid compacts. In one embodiment of this invention, HT-HP is used as a post-deposition binding step to bind the deposited particles to each other and to the substrate.

In some embodiments, an additional treatment step (not shown in the figures) is applied after the post-deposition treatment step 300, to add an additional phase to the coating. One example of this is the use of electrostatic spray coating or ultrasonic spray deposition as a final step, after deposition and sintering of a base coating, for the purpose of applying active biological agents to the base coating. As a more specific example, a dental implant or other biomedical device, possibly with a porous surface layer, can be coated using ESC followed by microwave sintering of the base coating. Then in an additional post-sintering deposition step, an active agent can be applied, such as a biocidal or anti-bacterial agent, other active agents such as bone-morphogenic proteins, or particles carrying drugs for drug delivery at the surface of the device after implantation. These are just examples of how a post-processing step can be used to apply additional components to a base coating for specific purposes.

Other additional treatment steps (not shown in the figures) that can be applied after post-deposition treatment 300 can be used to enhance the binding of the coating and to reduce or eliminate defects and non-uniformities in the coating. For example, suitable treatments for hard coatings such as those used for cutting tools include high temperature—high pressure (HT-HP) and infrared sintering (pulsed infrared radiation). Other methods using transient energy sources also may be used to enhance the characteristics of the final coating on the substrate.

Figure 2:
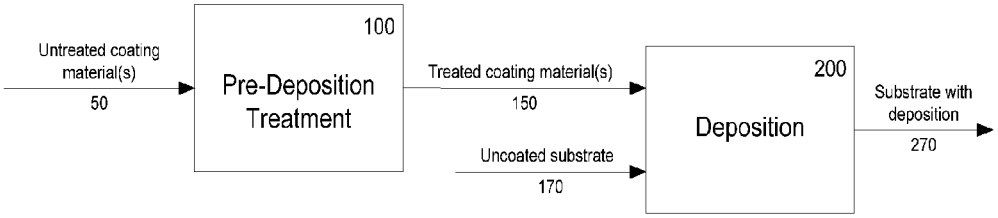
FIG. 2 shows the case in which a pre-deposition treatment is applied to the coating materials prior to deposition.

As shown in FIG. 2, some embodiments of the invention include an optional pre-deposition treatment step 100. Untreated coating materials 50 are treated prior to being passed as treated coating materials 150 to the deposition system 200. Pretreatment may be used to de-agglomerate the coating material particles. The pretreatment methods disclosed here can be used to treat materials prior to coating deposition, or for other purposes independent of any coating deposition system.

As a pre-processing step prior to deposition, the pre-treatment methods disclosed herein may be used for any one or more of the following purposes:

Fluidization, size discrimination and separation—fluidization helps maintain separation of dry powder particles, reduces agglomeration or clumping of particles, and allows preferentially feeding ultrafine particles or particles of smaller sizes; other methods for discriminating and preferentially feeding smaller particles also can be used.

De-agglomeration—it is well known that ultrafine particles and nanoparticles in particular have a tendency to clump together or agglomerate, forming clusters or 'agglomerates' that can be much larger than the base particle size. De-agglomerating the material helps reduce the number and size of clusters, which helps to maintain beneficial characteristics of nanosized particles, and improves the uniformity and surface roughness of the final coating when desired based on the application.

Functionalization—particles can be functionalized for specific purposes.

Methods and Apparatus for Pre-Deposition Treatment

Various methods and apparatuses for pre-deposition treatment of materials are described here. These may be used alone, or with the various deposition methods/systems described herein.

Method and Apparatus for Fluidization

Figure 3:
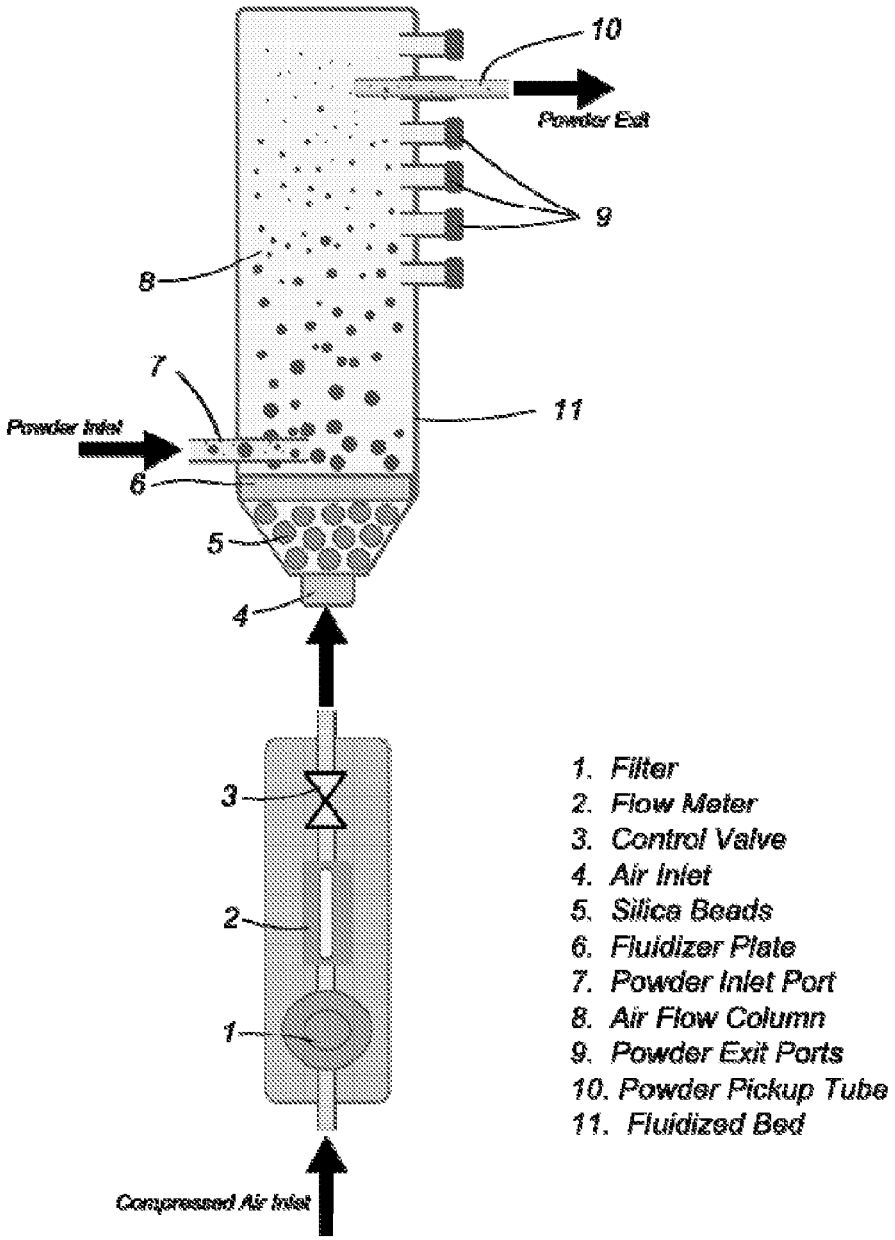
FIG. 3 illustrates a fluidizer, used to separate dry powder particles, avoid agglomeration, and preferentially feed ultrafine particles to the deposition system.

In one embodiment, dry powders consisting of nanoparticles, microparticles, or combinations thereof are fluidized using aerodynamic forces. FIG. 3 illustrates this. A fluidized bed (11) receives incoming powder via one or more powder inlet ports (7). The incoming powder may contain particles of different sizes, all of which are introduced to the fluidized bed. A supply of compressed air is provided through a suitable filter (1), flowmeter (2) and control valve (3) to the fluidizer air inlet (4). The control valve and flowmeter allow for control of the air flow rate. The air passes through a bed of silica beads (5), which help ensure uniform gas flow across the flow area and also act as a desiccant (the beads are replaced periodically). The air then passes through a porous fluidizer plate (6) and enters the chamber above where the powder is introduced at the inlet port (7).

The air flow rate is adjusted such that aerodynamic forces place the powder particles in motion, with smaller particles rising to the top of the fluidized bed (11). The result is a vertical gradient of average particle size over the height of the air flow column (8), with larger particles residing toward the bottom of the column and smaller particles residing toward the top. Multiple powder exit ports (9) are provided, allowing for adjustment of the size of particles to be drawn from the fluidizer. A powder pickup tube (10) is placed in one of the exit ports (9) to remove particles from the fluidizer. The unused ports are capped. The provision of multiple exit ports provides the capability for preferentially feeding ultrafine powder particles by adjusting the position of the powder pick-up tube (moving it from one exit port to another). In this method, the fraction of particles that are ultrafine must be balanced against deposition time due to the smaller mass flow rate of ultrafine particles.

In some embodiments, vibration also can be applied in combination with aerodynamic forces by incorporating vibrators (not shown) into the fluidizer. Vibration from the vibrators helps incite the additional movement of powder particles. The vibrators use mechanical vibrating energy created by a motor with an off-center mass rotating at high speed, or acoustical energy from sound waves.

Larger clusters of the powder accumulate at the bottom of the fluidized bed (11) and may be removed manually as part of a batch operation. For larger-scale operations, this may be automated by providing a powder removal and recycling capability.

Other Size Discrimination and Feeding Methods

Another method of discriminating the size of particles and preferentially feeding nano-sized or ultrafine particles is by screening the powder using a micron sieve. A sieve (perforated plate or screen) can be used to screen out larger particles, collecting and feeding only the smaller particles based on the size of the openings in the sieve. This can be used as an option for any of the pre-deposition treatment methods described herein.

Still other methods for separating and feeding particles of a certain size range include use of gravity, buoyancy, and/or centrifugal forces to separate particles of different sizes. One example is to entrain the particles in a fluid stream (using air, nitrogen or other gas), and turn the direction of this stream such that larger particles are thrown to the outside where they are removed and recycled, while smaller particles are carried downstream to the deposition system 200. A second example is to create a low-velocity upward flow of particles entrained in a gas such that buoyancy tends to cause smaller particles to rise while larger particles tend to fall due to gravity forces exceeding buoyancy forces. Smaller particles are removed from the top or side and fed to the deposition system 200.

De-Agglomeration

Methods for de-agglomerating particles are described below. These may be applied independent of any deposition system. Some of these methods of de-agglomeration will be described later in conjunction with integrated pre-treatment and deposition methods, and apparatus for performing pre-treatment and deposition.

Figure 4:
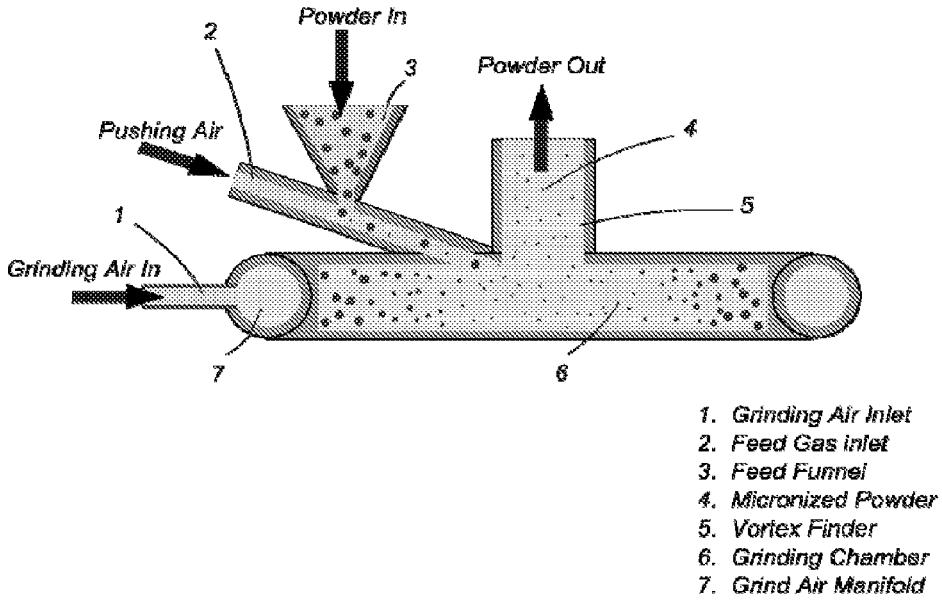
FIG. 4 illustrates a jet mill, which helps de-agglomerate powders using aerodynamic forces.

One method for de-agglomeration is use of a jet mill to break up clusters through impingement from a high-pressure gas jet. The gas may be air, nitrogen, or any of a variety of other suitable gases. FIG. 4 illustrates the jet mill. Dry powder enters the mill through a feed funnel (3). Two sources of air (or other gas) are provided, one as pushing air and the other as grinding air. Pushing air enters at the feed gas inlet (2), and it carries the incoming powder to the grinding chamber (6). Grinding air enters at the grinding air inlet (1) and is distributed around the chamber by the grind air manifold (7). Aerodynamic forces produced by the grinding air cause impact of the mixture of pushing air and powder particles against a solid wall or impingement pivots. This causes agglomerations to be broken apart, resulting in finer particles that collect at the center of the grinding chamber. These are picked up by the vortex finder (5), and the fine (or micronized) powder particles (4) then exit the mill via the powder outlet.

A second method for de-agglomeration is to disperse the particles in a liquid where the liquid has certain properties that promote dispersion and de-agglomeration. For example, we have used a solvent such as ethanol, combined with a surfactant that is "neutral" or bipolar. The liquid dispersion can be coupled with sonication to help achieve and maintain the desired dispersion of particles in the liquid. The liquid dispersion can be fed directly to the deposition system (e.g., for liquid ESC) or dried prior to feeding the material to the deposition system (e.g., for dry ESC).

A third method of de-agglomeration is to disperse the particles in a liquid as noted above, and then further de-agglomerating and drying the particles using an ultrasonic spray drying technique prior to feeding the dry powder to the deposition system. Ultrasonic spray drying involves use of an ultrasonic spray nozzle, which atomizes the liquid dispersion and in the process breaks up agglomerations through the action of the ultrasonic vibration. The droplets exit the ultrasonic nozzle and are then dried (e.g., via a cyclone dryer), evaporating the carrier liquid and leaving the fine particles behind in dry form. These are then carried in a gas stream to the deposition system. In addition to de-agglomerating the particles, ultrasonic spray also helps produce particles of uniform size by creating droplets of uniform size.

Figure 5:
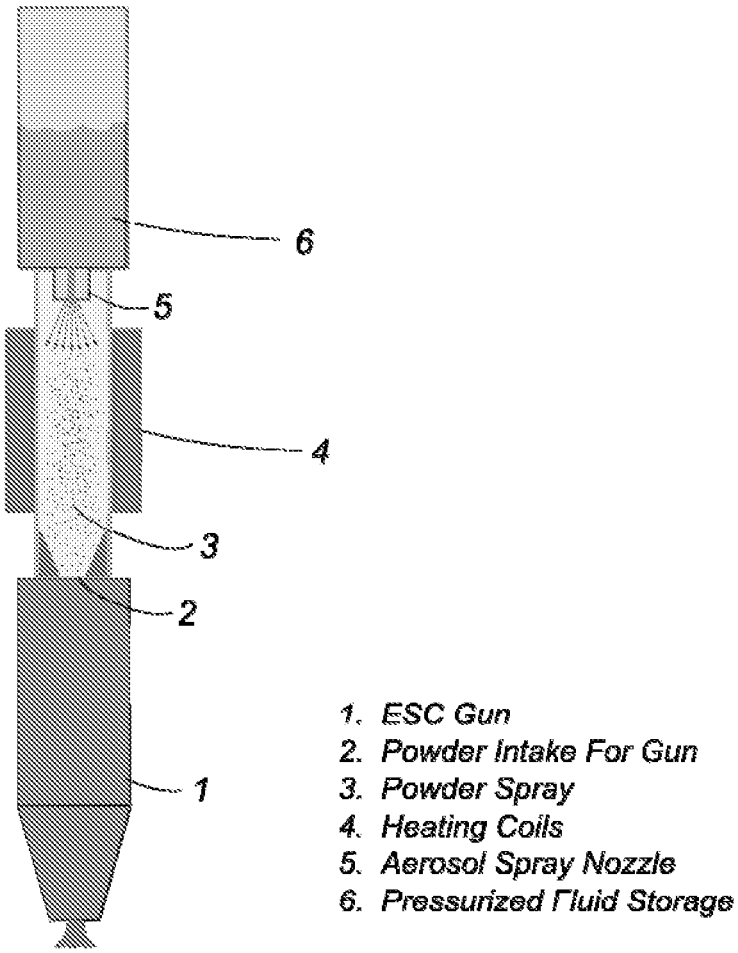
FIG. 5 shows an aerosol spray used to de-agglomerate powders as they are fed to the deposition system.

A fourth method of de-agglomeration is to create an aerosol that is fed to the deposition system 200. FIG. 5 illustrates this, showing one suitable apparatus for creating an aerosol. Powder is dispersed in a liquid (see discussion above regarding choice of suitable liquids for dispersion) and stored in a pressurized fluid storage chamber (6). The chamber may be pressurized using an over-pressure of air, nitrogen, or other suitable gas. The pressurized liquid with entrained particles becomes an aerosol as it exits the chamber via the aerosol spray nozzle (5). The aerosol is then heated using heating coils (4) such that the liquid is evaporated, leaving dry particles in a powder spray (3). The powder spray from the aerosol unit is directly connected to the inlet of the ESC gun (1) for electrostatic deposition. The flowrate of the mixture may be adjusted by modifying the pressure and/or the nozzle flow characteristics. The speed of evaporation may be accelerated or retarded by adjusting the power to the heating coil.

Combinations of the above-described methods also may be used. For example, one combined method of de-agglomeration is to first disperse the particles in a liquid to break up tightly-bound agglomerates (see discussion above for desirable liquid properties), then remove the liquid to dry the particles (at which point they may tend to re-agglomerate but in loosely-bound clusters), and then use a jet mill as a final step to break up any loosely-bound agglomerates that formed during or after drying. We have used this method successfully for pre-deposition treatment of cubic boron nitride powder prior to electrostatic spray deposition (see discussion of integrated pre-treatment and deposition below). The method we have used involves specifically the following steps:

1. Disperse cBN powder received from the manufacturer in a mixture of ethanol and a neutral or bipolar surfactant, for example Zonyl (made by DuPont)—we have used a mass ratio of surfactant to powder of about 0.51~1.5%.
2. Manually stir the liquid suspension, and then use vibration or ultrasonication to further ensure a uniform dispersion.
3. Dry the mixture in a container on a hot plate. To speed up the drying and also prevent humidity incursion, apply a flushing gas (we have used nitrogen at 50-70 deg. C. with controlled humidity/dewpoint) through several nozzles located around the periphery of the open container. Manually stir the mixture during drying to reduce caking Note that for scale-up to production levels, this operation could be automated.
4. Manually break up the resulting caked material using a mortar and pestle so that the result is a dry, loose powder that can be poured.
5. Pour the powder into the funnel of the jet mill, weighing the portions that are added so that the amount of material deposited can be controlled. For scale-up, this can be automated with a powder measurement unit (PMU).

For those methods that use liquid dispersion, the liquid dispersion can be coupled with sonication to help achieve and maintain the desired dispersion of particles in the liquid.

Functionalization

Functionalization of particles prior to deposition can allow coatings to be created for specific functions, or otherwise improve the characteristics of the resulting coating. Functionalization is typically realized by introducing a second phase or mixed phases of materials. For example, cubic boron nitride (cBN) particles can be over-coated with titanium nitride (TiN), titanium aluminum nitride (TiAlN), or aluminum oxide ($Al_2O3$) to improve the flowability of cBN particles and to increase the resistance of the coating to oxidization (for the case of TiAlN overcoating). Functionalization also can introduce a guest material (such as silica in ultrafine particle size) that is stable and provides effective spacing between host material particles, reducing the chances of agglomeration. This will further help to improve powder coating surface quality such as surface roughness.

One method of functionalizing particles, including nanoparticles, microparticles, and combinations thereof, is to over-coat the particles with other materials chosen for specific functionality. A second method of functionalizing particles is to disperse them in a liquid containing a surfactant, where the carrier liquid and surfactant are chosen to provide a stable dispersion. The liquid dispersion can be fed to the deposition system 200 as a liquid dispersion (e.g., for liquid ESC) or dried prior to feeding the material to the deposition system (e.g., dry ESC). Liquid dispersion can be coupled with sonication to help achieve and maintain the desired dispersion of particles in the liquid.

Additional Pre-Deposition Treatment Methods

Other pre-deposition treatment methods also can be used for pre-processing the coating materials prior to deposition, either alone or in combination with the methods described above. For example, the powder can be pre-heated to help drive moisture from the powder material. Ball milling also may be used to break up agglomerates and adjust the size of the powder particles provided to the deposition system.

Methods and Apparatus for Coating Deposition

Figure 6:
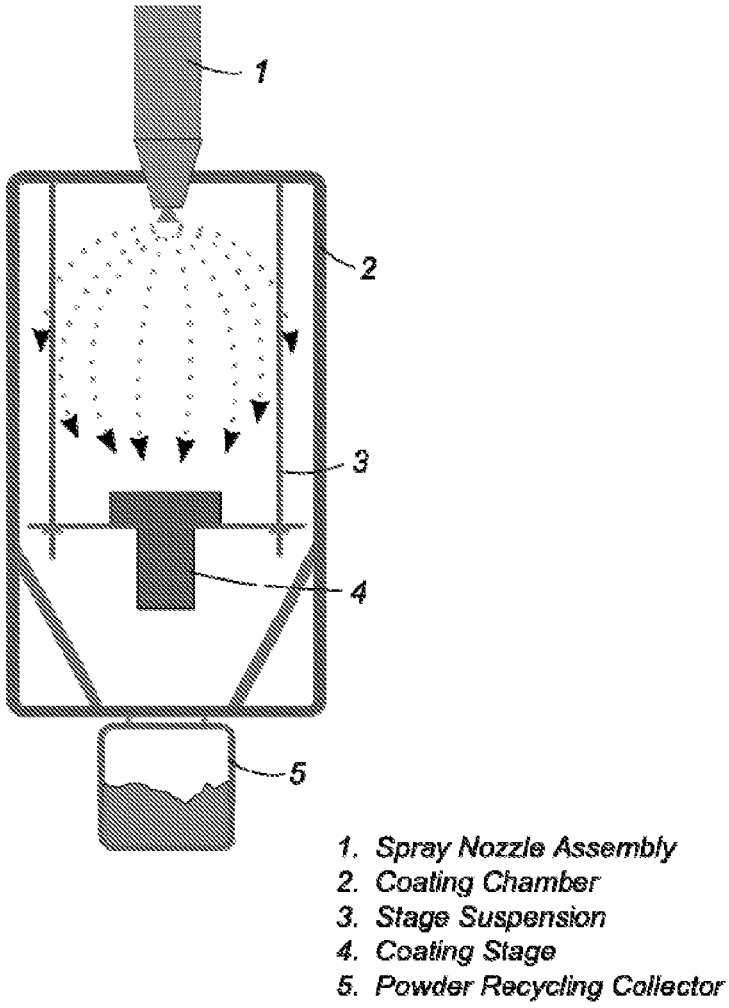
FIG. 6 shows the deposition chamber used to contain the materials being deposited, preventing unacceptable release to the environment, allow for adjustment of spray gun to substrate distance, and capture and recycle of unused coating materials.

FIG. 6 illustrates a deposition chamber that can be used for electrostatic spray coating (ESC) as well as other coating or deposition methods. A spray nozzle assembly (1) is mounted such that it sprays coating material (dry powder or liquid suspension containing particles) into the coating chamber (2). The spray nozzle assembly may employ electrostatic, ultrasonic, or ultrasonic plus electrostatic deposition means. The substrate(s) or part(s) to be coated are placed on a stage (4) that is suspended in the chamber using a stage suspension assembly (3). The orientation of the stage may be fixed or, as an option, a rotating stage may be used as described further herein. The distance between the stage and the spray nozzle can be adjusted.

The chamber is sealed so as to prevent egress of the coating material or ingress of contaminants. Material that is not deposited on the substrate(s) is collected in a powder recycling collector (5) so that material may be recycled. In the preferred embodiment, the unused material exits the sealed chamber via a liquid bath or other filtering means so that the material is captured for re-use and is prevented from being released to the environment.

In a preferred embodiment, the adjustments provided on the stage suspension assembly (3) are located external to the chamber by extending the assembly through the top of the chamber through openings that are sealed using O-ring type seals or other sealing means. With this design, adjustments in stage-to-nozzle distance can be made without opening the chamber.

Figure 7:
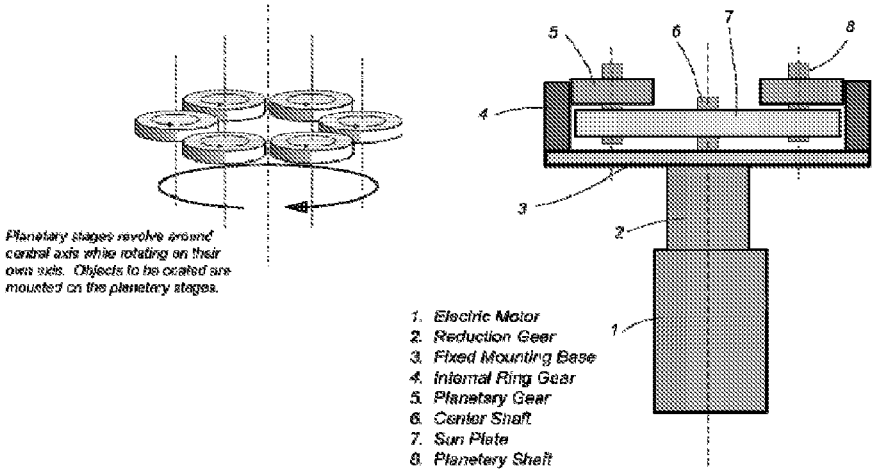
FIG. 7 illustrates a rotating stage used to ensure uniform deposition of the coating on the substrate.

FIG. 7 illustrates the rotating stage that is used as an option to improve uniformity of deposition across the surface of the substrate. The rotating stage can be used with electrostatic spray and other deposition methods. An electric motor (1) drives the apparatus through a reduction gear (2), causing the center shaft (6) to rotate. A sun plate (7) is attached to the center shaft (6) and rotates with the shaft. A number of planetary gears (5) are mounted to the sun plate (7) using planetary shafts (8). The planetary gears mesh with an internal ring gear (4) that is mounted to the fixed mounting base (3). In one embodiment shown in the figure, six planetary gears are used.

As the sun plate rotates, the planetary gears move around the central axis of the assembly and, due to their interaction with the internal ring gear, the planetary gears also rotate on their own axes. Substrates are mounted on the individual planetary gear stages. The dual rotation action enhances the uniformity of the deposition on the substrate by ensuring that all points on the surface of the substrate are exposed equally to the material spray.

The planetary and ring gears can mesh using conventional gear teeth, or the planetary gears can be made as rollers that are pressed outward (e.g., by springs) such that the outer edge of each roller contacts the surface of the internal ring gear and friction causes the planetary gears to rotate.

For any type of electrostatic deposition, the planetary gears must be grounded in order to ground the substrate that is mounted on them. This requires that a means be provided to electrically connect the planetary gears to a grounded member. In one embodiment in which the planetary gears are rollers, the springs that press against the planetary gear shafts and hold the planetary gears against the internal ring gear also act as brushes to make an electrical connection between the planetary gears and the rest of the grounded rotating stage assembly.

The speed of the electric motor can be adjusted to ensure that the substrate to be coated is exposed to all parts of the deposition spray pattern equally in order to achieve the desired uniformity of coating. The speed can be adjusted by changing the power input (voltage) to the DC motor. In the specific embodiment shown in the figure, the ratio of the rotational speed of the planetary gears to that of the overall sun plate is fixed by the gear ratio. However, in alternative embodiments one or more additional motors or other means can be provided such that the two speeds can be adjusted independently.

The rotating stage also can be translated by mounting it on an appropriate platform that is moved laterally in either the x or the y direction, and the stage also can be translated in the z-axis direction (vertical direction in the figure), moving the rotating stage closer to or further away from the spray source.

Integrated Pre-Treatment and Deposition Methods and Apparatus

Figure 8:
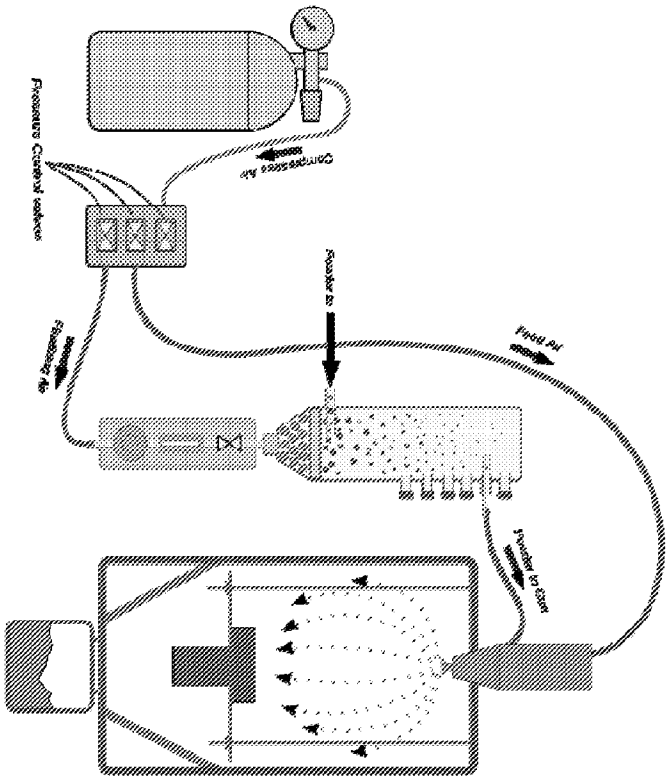
FIG. 8 shows fluidization integrated with the deposition system including the chamber.

FIG. 8 illustrates an electrostatic spray coating (ESC) system integrated with a fluidizer for pre-deposition treatment of the powder. Compressed air, nitrogen or other suitable gas is fed to a set of pressure control valves. These valves control the air to the fluidizer and the feed air to the ESC gun. By combining fluidization with ESC deposition, agglomeration of the dry powder particles is reduced and ultrafine particles are preferentially fed to the ESC gun. This system has been used to provide uniform deposition of powders such as hydroxyapatite on substrates including titanium implants for biomedical applications. The system is suitable for use with many other materials and applications.

Figure 9:
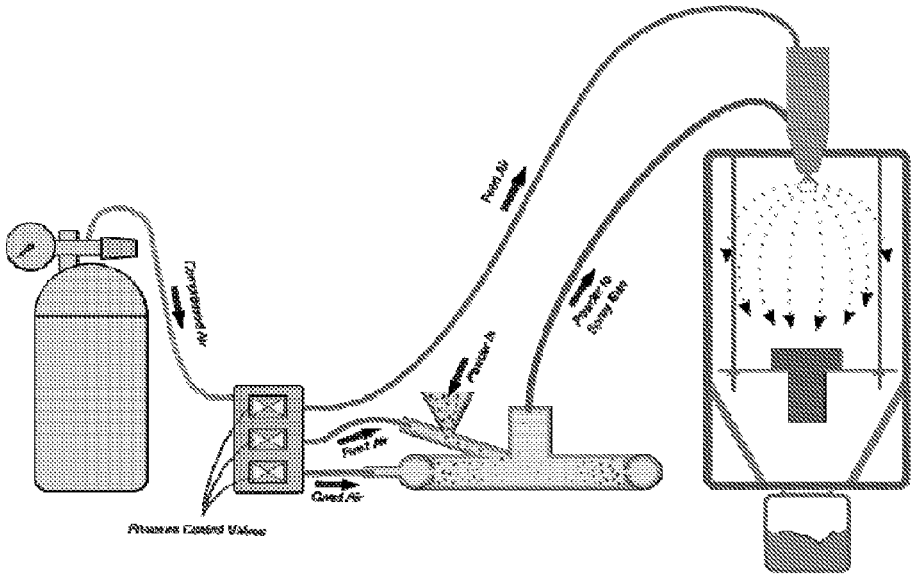
FIG. 9 shows the jet mill integrated with the deposition system including the chamber.

FIG. 9 illustrates an electrostatic spray coating (ESC) system with integrated jet mill for de-agglomeration of the incoming powder material. Compressed air, nitrogen or other suitable gas is provided to a set of pressure control valves. These valves control the feed air to the ESC gun, and both feed air and grinding air to the jet mill. Dry powder is fed to the powder inlet of the jet mill. The grinding action of the jet mill breaks up agglomerates, and fine powder particles are carried by the feed air out of the jet mill directly to the ESC gun. Commercially-available jet mills typically incorporate a cyclone powder collector with a collection bag for capturing the milled powder. In this invention, the cyclone and bag are removed and a custom-designed coupling is used to connect the jet mill output directly to the input hose connection of the ESC gun. The pressure control valves are used to adjust the overall air pressure applied, and the relative pressures applied in grinding and 'pushing' (feed air) through the jet mill. This allows adjustment of the balance between pushing and grinding forces in the jet mill, and adjustment of the balance between aerodynamic forces and electrostatic forces during particle deposition in the ESC chamber. ESC guns typically use a much lower air pressure than is used in a jet mill. Electrostatic forces dominate the particle deposition. By coupling the jet mill directly to the ESC gun the aerodynamic forces play a much larger role. We have found that the increased aerodynamic forces provide a much more uniform coating deposition. This is likely due in part to the fact that the electrostatic field lines are not uniform at the substrate, due to non-uniformities in the surface characteristics of the substrate. The aerodynamic forces tend to overcome these non-uniformities by reducing the influence of electrostatic forces in the deposition. This result, significantly improving uniformity of deposition owing to increased aerodynamic forces relative to electrostatic forces, was unexpected. Integration of the jet mill with the ESC system provides de-agglomeration of the incoming powder particles, which by itself improves coating uniformity, and further improves uniformity of particle deposition through the increased influence of aerodynamic forces.

Other optional features that can be included in the system described here are:

- Pre-heating of the carrier gas, when desired for specific applications;
- Automatic feed of the powder material to the system, and automatic measurement of powder quantity (e.g., using a powder measurement unit) and other key variables such as temperature, pressure, etc.; also, automation of the substrate rotation/translation;
- Use of a sieve as a further means of screening and separating particle sizes so that desired sizes of particles can be preferentially fed to the system;
- Vibration and sloped surface design to help prevent accumulation of powder on feed surfaces;
- Additional translation (in the x, y and/or z directions) of the substrate or ESC gun or both, to allow deposition on large surfaces; and
- Use of multiple guns to allow coating large surfaces or complex geometries.

Commercially-available ESC guns can be used for the electrostatic spray coating systems described herein. However, the off-the-shelf guns commonly used for painting and powder coating have some disadvantages when applied for deposition of micro- and nano-sized particles. Specifically, the guns do not provide uniform flow within the passages internal to the gun, resulting in some spatial non-uniformity of the flow exiting the gun. Also, there are areas within the gun where powder tends to accumulate, which affects the ability to control the thickness of the deposition by controlling the mass of powder sent to the gun.

Figure 10:
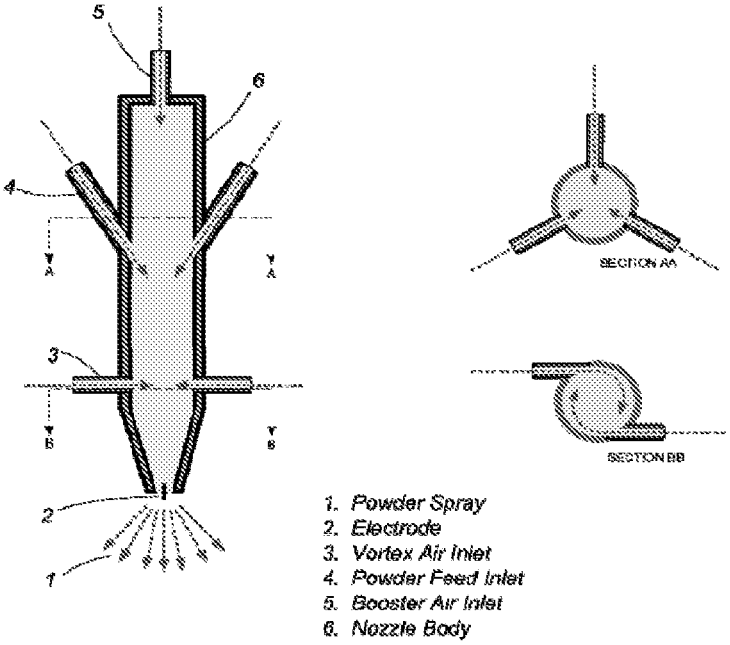
FIG. 10 illustrates a modified ESC gun design that minimizes accumulation of material inside the gun and improves uniformity of flow through the gun.

FIG. 10 illustrates a modified gun design that resolves these problems. Like the commercially available guns, air or other gas under pressure is provided to the gun along with a powder feed. An electrode (2) located at the nozzle exit charges the particles as they exit the gun, producing a charged powder spray (1). However, in this case multiple powder feed inlets (4) are provided and they are angled in the direction of the flow, so that powder more easily joins the air flow path. In addition, by providing multiple inlets (three are provided in the example shown in the figure); powder is more uniformly distributed around the circumference of the flow path.

Also, two separate air inlets are provided. One is the booster air inlet (5), which provides the main feeding air for creating the electrostatic spray. In addition, air is provided to one or more vortex air inlets (3). In the example shown in the figure, two vortex air inlets are provided. These inlets are oriented such that air enters tangentially, creating a vortex within the ESC gun that helps to prevent powder accumulation on the surfaces of the nozzle body (6) and also helps maintain uniformity of the gas and powder mixture flow. The nozzle body is designed to have smooth surfaces with no crevices or cavities in which powder can accumulate.

We claim:

1. A method for coating a substrate with a deposition material comprising a powder, comprising the steps of:

(a) applying a pre-deposition treatment to the deposition material, wherein said applying a pre-deposition treatment step comprises a step of de-agglomerating the deposition material;

(b) directing the deposition material onto the substrate by means of electrostatic charging, wherein the deposition material is directed into a flow path of a nozzle of an electrostatic charging unit through a plurality of powder inlets positioned around the flow path of the nozzle, at least one powder inlet forming an acute angle with the flow path of the nozzle, wherein main feed air is directed into the flow path of a nozzle of the electrostatic charging unit through a booster air inlet positioned in the flow path at a position that is upstream of the position in the flow path of the plurality of powder inlets, and wherein additional air is directed tangentially into the nozzle through a plurality of vortex inlets downstream of the position in the flow path of the plurality of powder inlets, each vortex inlet connecting at a tangential angle to the nozzle, whereby a vortex is created within the nozzle by air entering the nozzle through the plurality of vortex inlets; and (c) applying a sintering treatment to the substrate whereby the deposition material is adhered to the substrate.

2. The method of claim 1, wherein said directing the deposition material onto the substrate step further comprises the step of manipulating the substrate and wherein said manipulating substrate step comprises the step of rotating the substrate on a stage.

3. The method of claim 1, wherein the deposition material comprises at least one of the set comprising carbides, nitrides, carbonitrides, borides, oxides, sulfides, and silicides.

4. The method of claim 3, wherein the deposition material comprises boron nitride.

5. The method of claim 1, wherein said step of applying a sintering treatment comprises at least one of the set of microwave sintering, laser sintering, and infrared sintering.

6. The method of claim 1, wherein said pre-deposition treatment step comprises the step of fluidizing the deposition material.

7. The method of claim 6, wherein said pre-deposition treatment step comprises the step of fluidizing the deposition material aerodynamically wherein the deposition material is disposed as a fluidized bed on a fluidizer plate that receives a supply of compressed air passed through a desiccant and through the fluidizer plate.

8. The method of claim 7, wherein said fluidizing step further comprises the step of vibrating the deposition material.

9. The method of claim 7, wherein said fluidizing step comprises the step of sieving the deposition material.

10. The method of claim 1, wherein said de-agglomerating step is performed by means of a jet mill.

11. The method of claim 1, wherein said de-agglomerating step is performed by means of dispersing the deposition material in a non-aerosol dispersion liquid.

12. The method of claim 11, wherein said de-agglomerating step further comprises the step of applying sonication to the dispersion liquid.

13. The method of claim 11, wherein said de-agglomerating step further comprises the step of aerosolizing the dispersion liquid.

14. The method of claim 11, further comprising the step of applying an ultrasonic vibration to the dispersion liquid.

15. The method of claim 1, wherein said pre-deposition step further comprises the step of functionalizing the deposition material.

16. The method of claim 15, wherein said functionalization step comprises the step of overcoating the substrate.

17. The method of claim 15, wherein said functionalization step comprises the step of dispersing the deposition material in a mixture comprising a liquid and a surfactant.

18. The method of claim 17, further comprising the step of applying sonication to the mixture.

19. The method of claim 1, wherein the deposition material comprises micro-sized particles.

20. The method of claim 1, wherein the deposition material comprises nano-sized particles.

21. The method of claim 1, further comprising the step of directing an agent material to the substrate subsequent to said step of applying a sintering treatment to the substrate.

22. The method of claim 21, wherein the agent material comprises an active biological agent.

23. The method of claim 22, wherein the active biological agent comprises one of a biocidal and anti-bacterial agent.

24. The method of claim 21, wherein the agent material comprises a bone-morphogenic protein.

25. The method of claim 21, wherein the agent material comprises a drug-carrying agent.

26. The method of claim 1, wherein the booster air inlet is coaxial with the nozzle.

27. The method of claim 1, wherein the booster air inlet is configured to direct air in a direction toward an outlet of the nozzle.

* * * * *